US007587778B2

(12) United States Patent
Rosso et al.

(10) Patent No.: US 7,587,778 B2
(45) Date of Patent: Sep. 15, 2009

(54) WALLBOARD TAPING KNIFE WITH POLYMERIC HAMMER

(75) Inventors: Aaron Charles Rosso, Chicago, IL (US); Matthew Earle Myers, Naperville, IL (US); Scott Fong, Causeway Bay (HK)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 11/510,452

(22) Filed: Aug. 25, 2006

(65) Prior Publication Data

US 2008/0047074 A1 Feb. 28, 2008

(51) Int. Cl.
*B25D 1/04* (2006.01)
*B44D 3/16* (2006.01)
*B25G 1/00* (2006.01)

(52) U.S. Cl. ..... 7/143; 7/105; 81/492

(58) Field of Classification Search ..... 7/143, 7/105, 167; 81/492, 177.1; 30/169
See application file for complete search history.

(56) References Cited

U.S. PATENT DOCUMENTS

| | | | | |
|---|---|---|---|---|
| 1,779,293 | A | 10/1930 | Rodgers | |
| 3,562,826 | A | 2/1971 | Vaughn | |
| 3,605,832 | A | 9/1971 | Stephens | |
| 5,546,625 | A | 8/1996 | Mealey, Sr. | |
| 5,615,445 | A * | 4/1997 | Kelsay et al. | 81/177.1 |
| 5,956,788 | A | 9/1999 | Henke | |
| 5,956,799 | A * | 9/1999 | Panaccione et al. | 81/177.1 |
| 5,979,058 | A | 11/1999 | Henke | |
| 6,182,317 | B1 | 2/2001 | Huang | |
| 6,272,708 | B1 | 8/2001 | Chen | |
| 6,421,860 | B1 | 7/2002 | Abbott | |
| 6,530,098 | B1 * | 3/2003 | Gringer et al. | 7/105 |
| 2007/0017101 | A1 * | 1/2007 | Perez et al. | 30/169 |

* cited by examiner

*Primary Examiner*—Hadi Shakeri
(74) *Attorney, Agent, or Firm*—Greer, Burns & Crain, Ltd.; David F. Janci, Esq.; Pradip Sahu, Esq.

(57) ABSTRACT

A tool includes a blade with a working end and a handle end opposite the working end, a handle secured to the handle end and having a blade end and a hammer end, a hammer secured to the hammer end and having a body made of a relatively hard, lightweight polymeric material.

8 Claims, 3 Drawing Sheets

WALLBOARD TAPING KNIFE WITH POLYMERIC HAMMER

FIELD OF THE INVENTION

This invention relates generally to hand tools such as wallboard taping knives or similar painter's tools used for applying joint compound to wallboard joints and seams, and specifically to such a tool having an improved hammer.

Conventional taping knives are known to have hammers on the handles opposite the taping blade for completing the driving of wallboard screws or nails below the surface of the wallboard being finished. Such hammers are typically made of solid metal, such as zinc, which is popular for its durability, corrosion resistance and relatively low cost. In addition, zinc has the ability to be used as a "pencil" and write on the joint compound. Another advantage of hammers on taping knives is that if the tool is dropped from a ladder, the tool will likely fall on the hammer rather than the blade, which ideally should be preserved for applying smooth and even coats of joint compound.

However, users of such knives have experienced shoulder and arm fatigue after prolonged use of such tools. One perceived reason for this fatigue is the added weight and imbalance to the knife caused by the zinc hammer.

Therefore, there is a need for an improved taping knife having a hammer addresses and overcomes the above-listed drawbacks.

BRIEF DESCRIPTION OF THE INVENTION

The above-listed objects are met or exceeded by the present tool such as a taping knife having a hammer manufactured from a relatively hard and lightweight polymeric material, preferably polycarbonate. This hammer provides the rigidity suitable for hammering partially driven fasteners into the wallboard, while also reducing tool weight and improving balance. In one embodiment, the hammer is provided in a hybrid format, with a first portion made of polymeric material such as polycarbonate, and a zinc cap secured over the polycarbonate hammer core. The latter embodiment features additional impact resistance as well as the ability to write on the joint compound. Another feature of the present hammer is that it is not directly connected to the blade, as through a shank, which reduces damage to the tool or additional user fatigue through shocks generated by hammering.

More specifically, the present tool includes a blade with a working end and a handle end opposite the working end, a handle secured to the handle end and having a blade end and a hammer end. A hammer is secured to the hammer end and has a body made of a relatively hard, lightweight polymeric material.

In another embodiment, a tool includes a blade with a working end and a handle end opposite the working end, and a handle secured to the handle end and having a blade end and a hammer end. A hammer is secured to the hammer end and has a body including a hammer portion made of a polymeric material. The hammer body has an axial core with a skirt projecting from a common impact end, the skirt defining a shoulder. A metallic cap is configured for attachment to the hammer body and has an edge engaging the shoulder so that upon assembly, the cap is flush with an exterior surface of the body.

In yet another embodiment, a hammer is provided for a tool having a handle, and includes a hammer body defining a generally axial core and a skirt projecting from a common end, the skirt defining a shoulder. A metallic cap is configured for being fastened to the hammer body and has an edge engaging the shoulder so that upon assembly, the cap is flush with an exterior surface of the body. The cap has a central boss engaging a socket in the body.

DETAILED DESCRIPTION OF THE INVENTION

Figure 1:
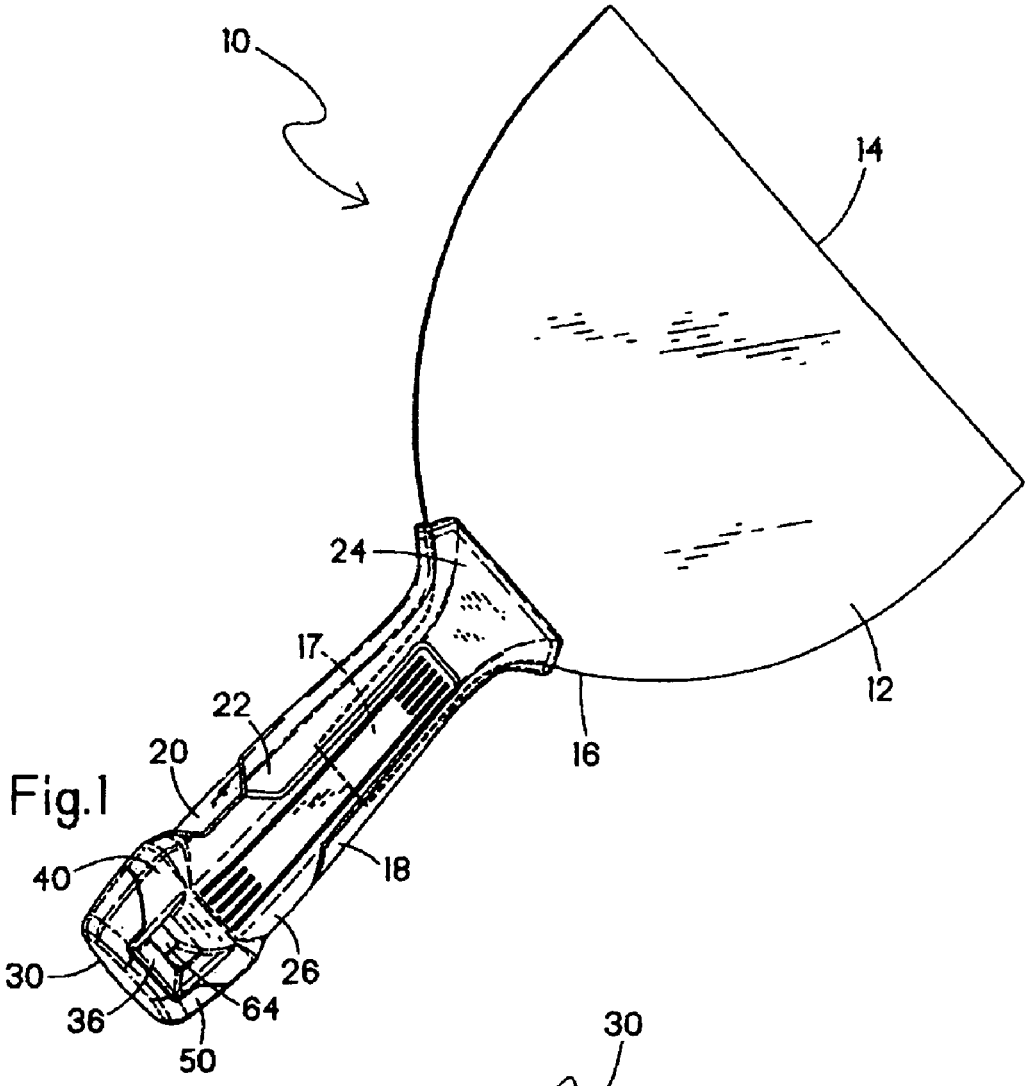
FIG. 1 is a top perspective view of a tool incorporating the present hammer.

Referring now to FIGS. 1-4, a preferred embodiment of the present tool is a taping knife, is generally designated 10 and includes a blade 12 having a working end 14 and a handle end 16 having a shank 17 (shown hidden) opposite the working end. While a taping knife is the preferred tool, it is contemplated that other hand tools such as scrapers may be provided with the present hammer, described below. As is known in the art, the blades 12 may be provided in a variety of widths and shapes, some lacking shanks, but the working end 14 is preferably a straight edge for smoothing wallboard compound or similar settable substances. It is important for users of such tools that if the tool is inadvertently dropped, especially from a height, such as from a ladder, the working end 14 should not impact the ground, which may damage the edge.

A handle 18 is secured to the handle end 16, preferably by insert molding so that the handle and the blade 12 become integrally joined. However, other attachment technologies are contemplated, such as rivets or threaded fasteners. It is also contemplated that the handle 18 is provided in multiple portions, such as a relatively harder plastic inner portion 20 with a relatively resilient over molded gripping portion 22, as is known in the art. A suitable handle construction is provided in commonly-assigned U.S. Ser. No. 11/187,582 filed Jul. 22, 2005, which is incorporated by reference.

In the preferred embodiment, the handle 18 has a blade end 24 and a hammer end 26 opposite the blade end. A hammer 30 is secured to the hammer end 26 of the handle 18, and has a body 32 having a first end 34 configured for being secured to the handle, and a second, opposite end 36 designed for withstanding impact. In the preferred embodiment, the hammer 30 is at least partially made of a polymeric material which is relatively hard and lightweight when compared to a typical zinc hammer. The contemplated polymer is polycarbonate; however equivalent materials are contemplated provided they are comparable in weight, impact resistance, moldability and cost.

More specifically, the body 32 includes a generally axially disposed core 38 and a skirt 40 radially spaced from the core but integrally joined thereto. The skirt 40 projects generally toward the blade 12 and has an exterior surface 42 and an edge 44 configured for engaging the handle 18.

Figure 2:
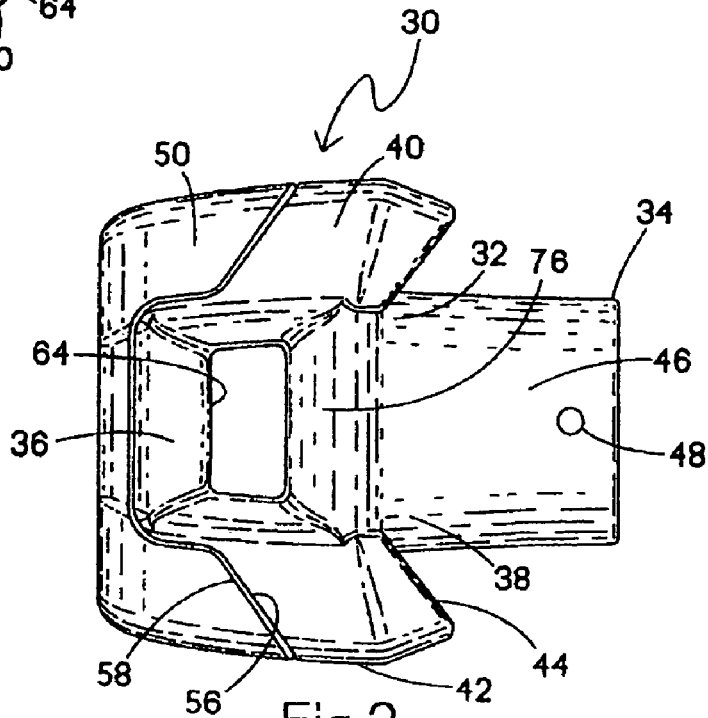
FIG. 2 is a front elevation view of the hammer of the tool of FIG. 1.
Figure 3:
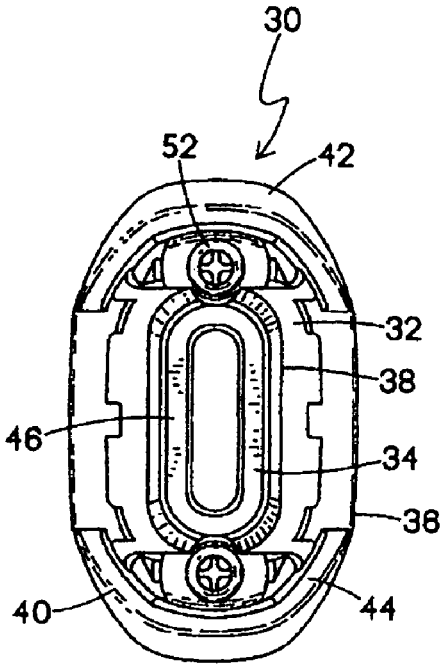
FIG. 3 is a bottom elevation view of the hammer of FIG. 2.

Referring now to FIG. 2, the core 38 has a tongue portion 46 projecting toward the blade and extending beyond the edge 44 of the skirt 40. The tongue portion 46 is preferably hollow, and is received in a pocket of the handle 18. A pin (not shown) passes through the handle 18 and a mounting hole 48 for securing the hammer 30 to the handle 18. In addition, it is contemplated that the core 38 may be secured to the handle 18 by chemical adhesives, ultrasonic welding, insert molding or the like.

A feature of the present hammer is that it is axially displaced from an opposing handle end 16 of the blade 12. In other words, the handle 18 separates the hammer 30 from the blade 12. This axial displacement disperses shock impact forces when the hammer 30 is used for hammering. This displacement protects the blade 12 and also reduces shock to the user's hand.

Figure 4:
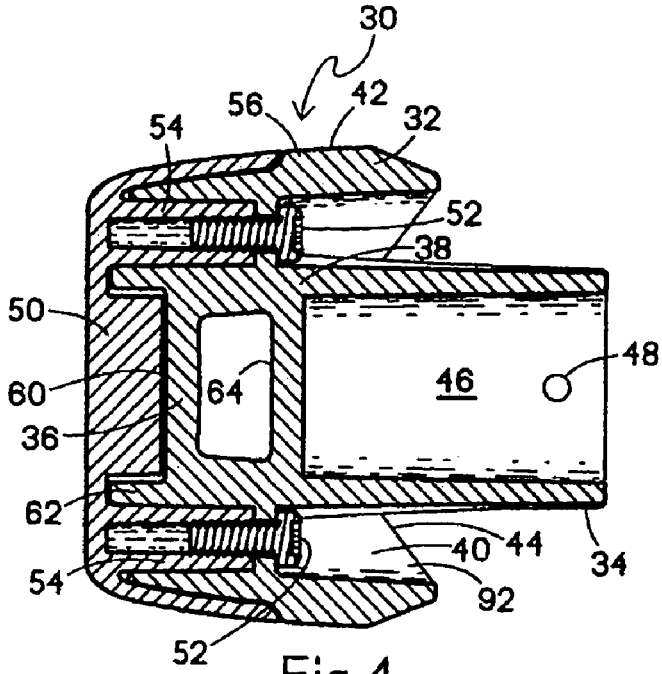
FIG. 4 is vertical cross-section of the hammer of FIG. 2.

Referring now to FIGS. 2 and 4, the second or impact end 36 of the hammer body 32 is preferably provided with a metallic cap 50, which is contemplated as being zinc. Zinc is a hard, economical metal which also features the ability to "write" on wallboard compound, however, other metals which are comparable in hardness, weight and cost are contemplated. The cap 50 is secured to the body 32 by at least one threaded fastener 52 which is preferably parallel to the axis of the hammer 30 and engages a corresponding, optionally threaded, depending boss 54 on the cap; however other types of fasteners or fastening technologies mentioned above are also contemplated.

On the core 38, a shoulder 56 is defined on the skirt 40, and accommodates an annular edge 58 of the cap 50 so that the cap is generally flush with the exterior surface 42 of the body 32. A central boss 60 of the cap 50 is received in a socket 62 of the body 32 (FIG. 4). Also included on the body 32 is a hanging hole 64. An advantage of using polymeric materials such as polycarbonate for the hammer 30 is that the hanging hole 64 may be located near the second or impact end 36 without detracting from the structural integrity of the hammer.

Figure 5:
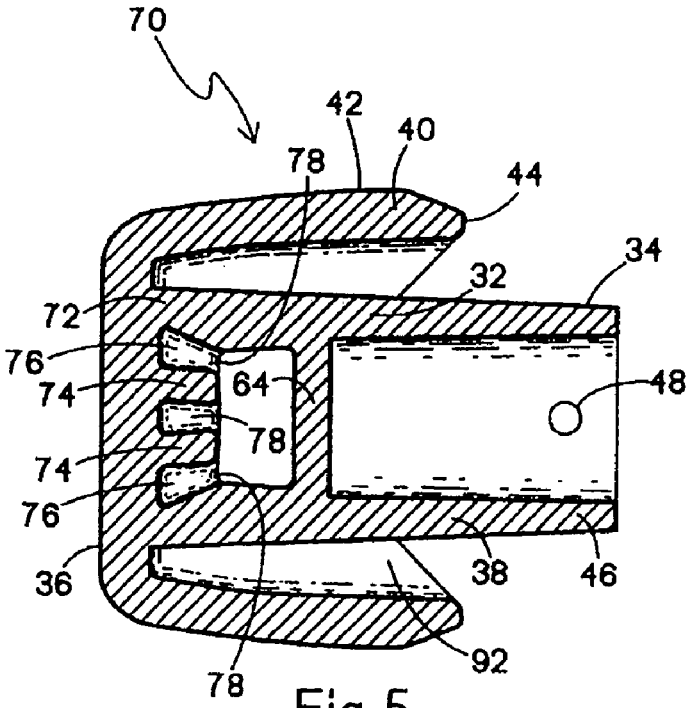
FIG. 5 is a vertical cross-section of an alternate embodiment of the hammer of FIG. 2.

Referring now to FIG. 5, an alternate embodiment of the hammer 30 is generally designated 70. Components shared between the hammers 30, 70 are designated with identical reference numbers. A main distinctive feature of the hammer 70 is that it is completely made of polymeric material, here polycarbonate. As such, in view of a lack of the metallic cap 50, the axial core-portion 38 is joined to the skirt 40 by a common thickened impact formation 72, which also forms the second or impact end 36.

Another distinction of the hammer 70 is that it includes a plurality of castellations 74 which border the hanging hole 64. The castellations 74 are preferably integrally formed with the hammer 70, and are spaced, generally axially extending formations which improve the moldability of the purely polymeric hammer 70. It will be seen that the castellations 74 are preferably inclined or beveled towards the hanging hole 64 (FIG. 5). The castellations 74 separate grooves 76 formed adjacent the castellations. A wall 78 closes off a rear portion of the grooves 76 and separates each groove from a corresponding groove on the opposite side of the hammer.

Figure 6:
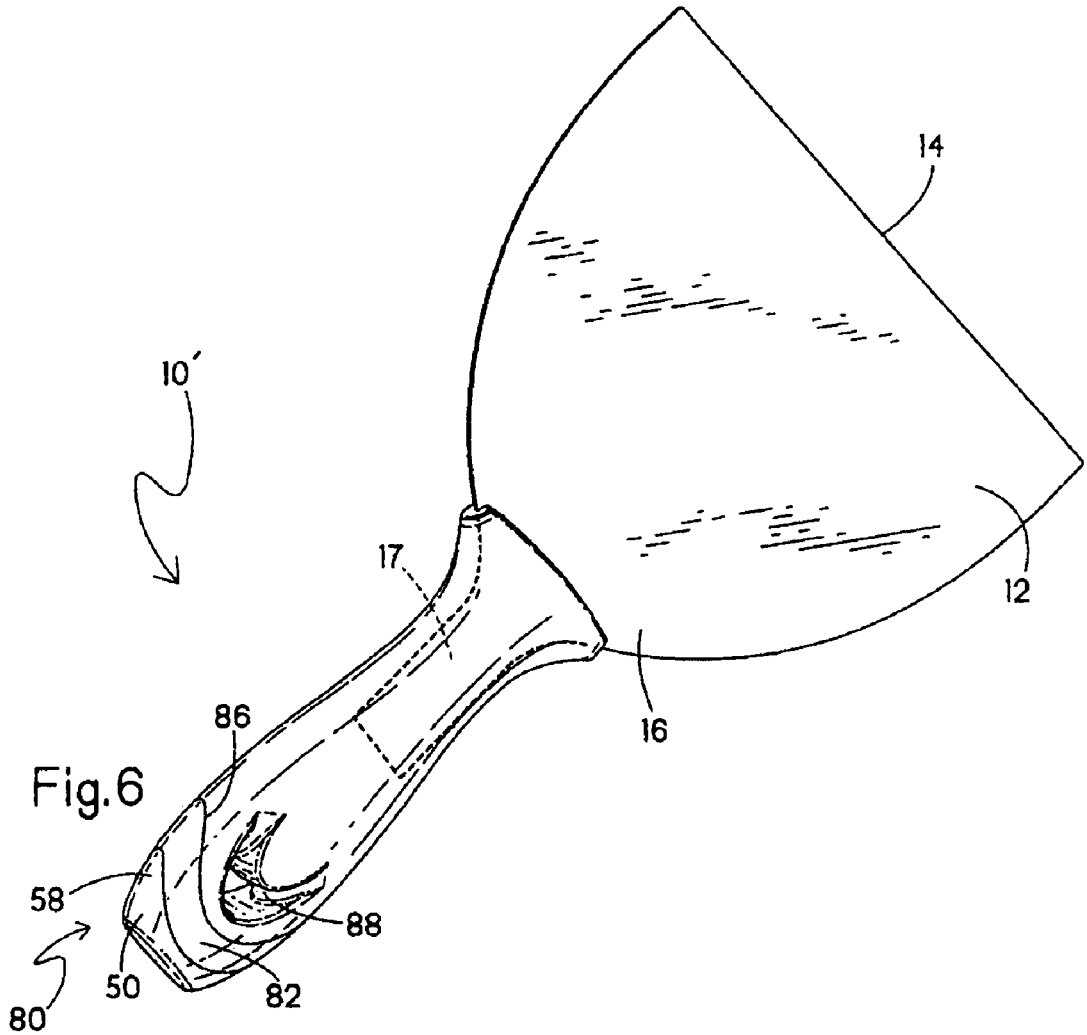
FIG. 6 is a top perspective view of another tool equipped with an alternate embodiment of the present hammer.
Figure 7:
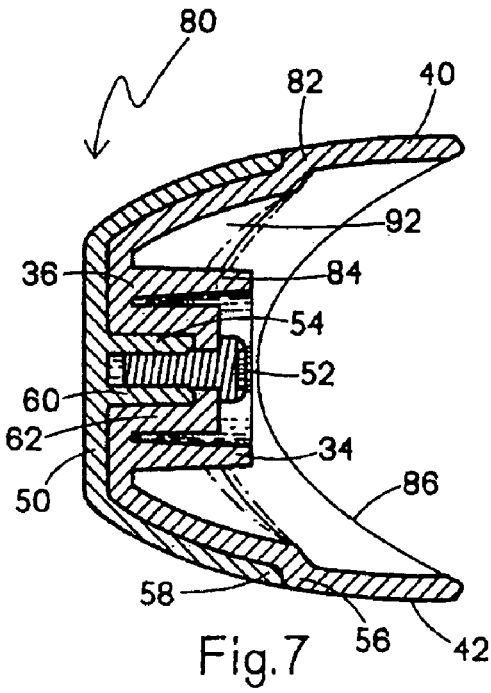
FIG. 7 is a vertical cross-section of the hammer of FIG. 6 shown partially in section.

Referring now to FIGS. 6 and 7, an alternate embodiment of the tool 10 is designated 10' and is provided with another alternate embodiment of the present hammer is generally designated 80. Shared components with the previous hammers are designated with identical reference numbers. The hammer 80 is similar to the hammer 30 in that it has a polymeric body 82 preferably made of polycarbonate, and a cap 50 secured to the body 82 by at least one fastener 52. The cap 50 is preferably made of zinc for the reasons indicated above. In the hammer 80, a core 84 does not extend past a generally arcuate edge 86 of the skirt 40. In addition, the hammer 80 lacks the hanging hole 64. Instead, in the tool 10', the hanging hole 88 is in the handle 18.

Figure 8:
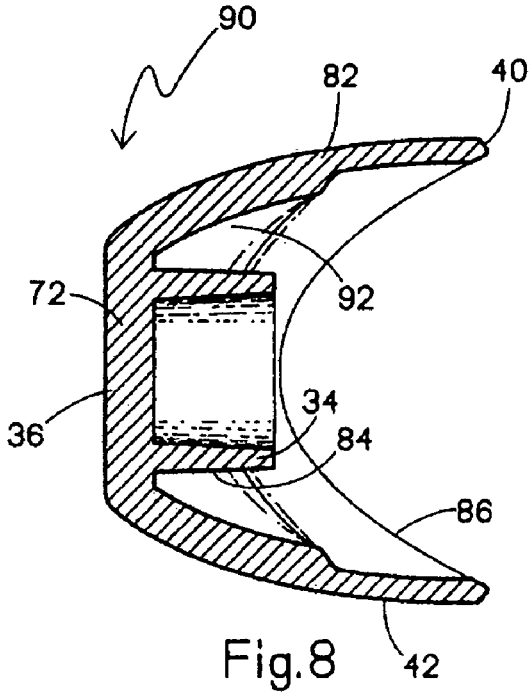
FIG. 8 is a vertical cross-section of a still another alternate embodiment of the present hammer.

Referring now to FIG. 8, still another alternate embodiment of the present hammer is generally designated 90. Shared components with the previous hammers are designated with identical reference numbers. The hammer 90 is similar in overall shape to the hammer 80, but is similar to the hammer 70 in that it lacks the metal cap 50, and is purely polymeric, preferably polycarbonate. As such, the skirt 40 and the core 38 are joined along a common thickened impact formation 72. Also, the core 82 does not extend past the edge of the skirt 40. As is the case with the hammers 30, 70 and 80, a space 92 is defined between the skirt 40 and the core 38, 84. As is the case with the hammer 80, the core 84 does not project past the edge 86 of the skirt 40.

It has been found that tools 10 such as taping knives or the like equipped with hammers 30, 70, 80, 90 are relatively lighter in weight than conventional metal/hammered tools. As such the present tool is easier to use for longer periods without causing operator fatigue, and is also more balanced, facilitating manipulation by the user or operator.

While particular embodiments of drywall taping knives with polymeric hammers have been shown and described, it will be appreciated by those skilled in the art that changes and modifications may be made thereto without departing from the invention in its broader aspects and as set forth in the following claims.

What is claimed is:

1. A tool, comprising:

a blade with a working end and a handle end opposite said working end;

a handle secured to said handle end and having a blade end and a hammer end;

a hammer secured to said hammer end and defining an extreme endpoint of said handle, said hammer having a body made of a relatively hard, lightweight polymeric material and a skirt projecting toward said blade from a common thickened impact formation forming said endpoint; and a metallic cap provided on said hammer and covering said impact formation, said cap having a portion projecting toward said blade and covering a portion of said skirt.

2. The tool of claim 1 wherein said cap is secured to said hammer by at least one fastener.

3. The tool of claim 1 wherein said cap is made of zinc.

4. The tool of claim 1 wherein said hammer body includes a recessed shoulder located in said portion projecting toward said blade and configured for receiving an edge of said cap so that upon mounting to said body, said cap is flush with an exterior surface of said body.

5. A tool, comprising:

a blade with a working end and a handle end opposite said working end;

a handle secured to said handle end and having a blade end and a hammer end;

a hammer secured to said hammer end and having a body configured for being secured to the handle and including a hammer portion made of polycarbonate;

said hammer body having an axial core with a skirt projecting from a common end, said skirt defining a shoulder, at least a portion of said skirt projecting from said body toward said blade over opposing sides of said handle;

a metallic cap configured for fastening to and covering said hammer body, said cap having a portion projecting toward said blade and covering a portion of said skirt and an edge engaging said shoulder so that upon assembly, said cap is generally flush with an exterior surface of said body.

6. The tool of claim 5 wherein said body includes a tongue projecting axially beyond an end of said skirt for attachment to said handle.

7. The tool of claim 5 wherein said core has an end closer to said blade and is axially displaced from an end of said handle end for displacing shock impacts on said hammer.

8. A tool, comprising:

a blade with a working end and a handle end opposite said working end;

a handle secured to said handle end and having a blade end and a hammer end;

a hammer secured to said hammer end, said hammer including a body and a skirt projecting from said body toward said blade on opposing sides of said handle, said body defining a pair of through holes; and a metallic cap covering said body and having a portion projecting toward said blade and covering a portion of said skirt, said cap defining a pair of bosses that are aligned with said through holes, wherein said cap is secured to said body by inserting a fastener through each of said through holes and into engagement with a corresponding one of said bosses.

* * * * *